US010139135B1

(12) United States Patent
Lesage

(10) Patent No.: US 10,139,135 B1
(45) Date of Patent: Nov. 27, 2018

(54) AUTOMATIC HOT WATER PULSATING ALARM FOR WATER HEATERS

(71) Applicant: MICLAU-S.R.I. INC., Montreal East (CA)

(72) Inventor: Jean-Claude Lesage, Kirkland (CA)

(73) Assignee: MICLAU-S.R.I. INC., Montreal East, QC (CA)

( * ) Notice: Subject to any disclaimer, the term of this patent is extended or adjusted under 35 U.S.C. 154(b) by 0 days.

(21) Appl. No.: 15/731,332

(22) Filed: May 30, 2017

(51) Int. Cl.

| | |
|---|---|
| ***F22B 37/42*** | (2006.01) |
| ***F24H 9/20*** | (2006.01) |
| ***G05D 7/06*** | (2006.01) |
| ***G08B 21/02*** | (2006.01) |
| *F24H 1/18* | (2006.01) |

(52) U.S. Cl.
CPC ..... *F24H 9/2007* (2013.01); *G05D 7/0623* (2013.01); *G08B 21/02* (2013.01); *F24H 1/18* (2013.01)

(58) Field of Classification Search
CPC ..... F24H 9/205; F22B 37/42; F22B 37/426; F22B 37/428; F23N 2023/08; G05D 23/1951
See application file for complete search history.

(56) References Cited

U.S. PATENT DOCUMENTS

| | | | | |
|---|---|---|---|---|
| 7,299,814 | B2 * | 11/2007 | Fenton | F17D 5/02 137/1 |
| 8,360,334 | B2 * | 1/2013 | Nold | G05B 19/0428 236/51 |
| 2011/0283958 | A1 * | 11/2011 | Lesage | F22B 37/42 122/504.2 |
| 2015/0053284 | A1 * | 2/2015 | Gonzalez Garza | F27B 7/20 137/558 |
| 2018/0172316 | A1 * | 6/2018 | Smelcer | F24H 9/2035 |

* cited by examiner

*Primary Examiner* — Gregory A Wilson
(74) *Attorney, Agent, or Firm* — Guy J. Houle; Houle Patent Agency Inc.

(57) ABSTRACT

A hot water pulsating alarm system and method for electric or gas-fired water heaters is described. A sensor senses the water temperature in an upper region of the water tank of the water heater and feeds temperature signals to a controller. The controller operates an electromechanical valve connected to the pressurized cold water supply line of the water tank. Upon detecting a low temperature value stored in the memory of the controller, the controller causes a shut-off electro-mechanical valve to close and open in a predetermined sequence and during a predetermined time period. This causes interruptions of hot water being drawn from the upper region of the water tank to feed a hot water supply conduit and creating a pulsating water temperature change in hot water being discharged through fixtures connected to the hot water supply conduit. The pulsating temperature change is detected by a user person having a body part in contact with water dispensed from fixtures secured to the hot water supply conduit and indicating to the user person that the water heater will be shut-off.

16 Claims, 1 Drawing Sheet

AUTOMATIC HOT WATER PULSATING ALARM FOR WATER HEATERS

FIELD OF THE INVENTION

The present invention relates to a hot water pulsating alarm system and method including a computer programmed controller to automatically provide a hot water pulsating alarm to a user person in contact with hot water or a mixture thereof being dispensed through fixtures connected to the hot water supply line of a water heater.

BACKGROUND OF THE INVENTION

Water heaters for domestic use are commonly of two types, electric water heaters and gas-fired water heaters. With electric water heaters resistive heating elements project in the water tank and heat the water therein. With gas-fired water heaters a combustion chamber is located under the bottom wall and a gas burner is fired to heat the bottom wall and the water within the tank, Also, the flue gases from the combustion chamber extends through the tank and also heats water therein. Typically, water is heated to maintain a temperature of about 140 degrees F. When hot water is drawn from the upper region of the tank, domestic cold water under pressure is introduced in the bottom region of the tank. If for any reason the water temperature in the upper region of the tank falls the cut in setpoint of the upper thermostat, it is an indication that there is a problem with the heating devices or an over draw of hot water. Such low temperature also poses a risk that undesirable bacteria could be present as they may have proliferated in stagnant water in the bottom region of the tank and which has risen to the upper region of the tank due to an excessive draw of hot water from the upper region.

It is known that the *Legionella* bacteria is promoted in stagnant water. When there is no draw of hot water from a water heater the only movement of water within the tank is cause by the heating sources which causes water disturbances as hot water rises. If the heating sources are defective, and there is now draw of hot water for a long period of time, then water becomes stagnant creating dead spaces in which deposits and sediment formation can arise creating a culture medium for bacteria proliferation.

In view of the above, there is a need to provide an automatic warning system to a user person that the water temperature in the upper region of the tank is approaching a low temperature value, which may be unsafe to be exposed to, and that there may be a problem with the water heater and that the water heater will be shut-down until the water temperature in the upper region rises to a desirable safe temperature, commonly about 140 degrees F.

SUMMARY OF THE INVENTION

It is a feature of the present invention to provide an automatic alarm system which provides the above mentioned need.

Another feature of the present invention is to provide a water pulsating alarm system wherein the supply of hot water is pulsated to give an alarm to a user person having a body part in contact with hot or lukewarm running water in a fixture of an appliance, such as a shower, that the hot water supply will be interrupted.

Another feature of the present invention is to provide a computer implemented method for automatically initiating a hot water pulsating alarm by a controller of a water heater.

A still further feature of the present invention is to provide the computer implemented method above described and which method also initiates a local audible alarm and transmits alarm information to remote devices wired or wireless.

A further feature of the present invention is to provide a computer programmed controller capable of providing the above mentioned need.

According to the above features, from a broad aspect, the present invention provides a hot water pulsating alarm system for water heaters. The system comprises a controller and a temperature sensor secured to a water tank of the water heater in an upper region of the water tank where hot water is drawn through a water outlet to feed a hot water supply conduit. The temperature sensor feeds temperature signals to the controller representative of actual water temperature in the upper region of the water tank. A domestic water supply conduit feeds water under pressure to a water inlet conduit of the water tank to replenish water in the water tank drawn through the water outlet. A shut-off valve is secured to the water inlet conduit. A communication link is provided between the controller and the shut-off valve for operating the state of the shut-off valve. The controller has a computer readable memory having recorded thereon statements and instructions for executing by a computer the statements and instructions when receiving predetermined temperature signals from the temperature sensor. The controller when receiving a predetermined low temperature signal from the sensor causes the shut-off valve to be operated to close and open in a predetermined sequence and during a predetermined time period to cause interruptions of the water under pressure to the water inlet and consequently to the feed of hot water to the hot water supply conduit in the event that hot water is being drawn to create a pulsating water temperature change of water being drawn through fixtures connected to the hot water supply conduit and which temperature change constitutes a pulsating signal to a user person having a body part in contact with the pulsating water temperature change that the water heater will be shut off.

According to a further broad aspect of the present invention there is provided a computer implemented method for automatically initiating a hot water pulsating alarm by a controller of a water heater which controls a shut-off valve connected to a domestic water supply conduit which feed water under pressure to a water inlet conduit of a water tank of the water heater. The water tank has a water outlet in the upper region thereof to draw hot water to feed a hot water supply conduit. The method comprises the steps of:

(i) providing a controller having a computer readable memory having recorded thereon statements and instructions for executing by a computer the statements and instructions, (ii) sensing by a temperature sensor the actual water temperature in an upper region of the water tank, (iii) feeding temperature signals to the controller indicative of actual water temperatures sensed by the temperature sensor, (iv) operating a shut-off valve by the controller, when receiving a predetermined low temperature signal from the temperature sensor, to close and open the shut-off valve in a predetermined sequence for a predetermined period of time to cause interruptions of the water under pressure to the water inlet and consequently to the feed of hot water to the hot water supply conduit to create a pulsating water temperature change of water being drawn through fixtures connected to the hot water supply conduit and which temperature change constitutes a pulsating signal to a user person having a body part exposed to the pulsating water temperature change that the water heater will be shut-off.

According to a still further broad aspect of the present invention there is provided a computer programmed controller comprising a computer readable memory having computer executable instructions thereon that when executed by a computer performs the above mentioned computer implemented method steps.

BRIEF DESCRIPTION OF THE DRAWINGS

A preferred embodiment of the present invention will now be described with reference to the accompanying drawings in which.

DETAILED DESCRIPTION OF THE PREFERRED EMBODIMENT

Figure 1:
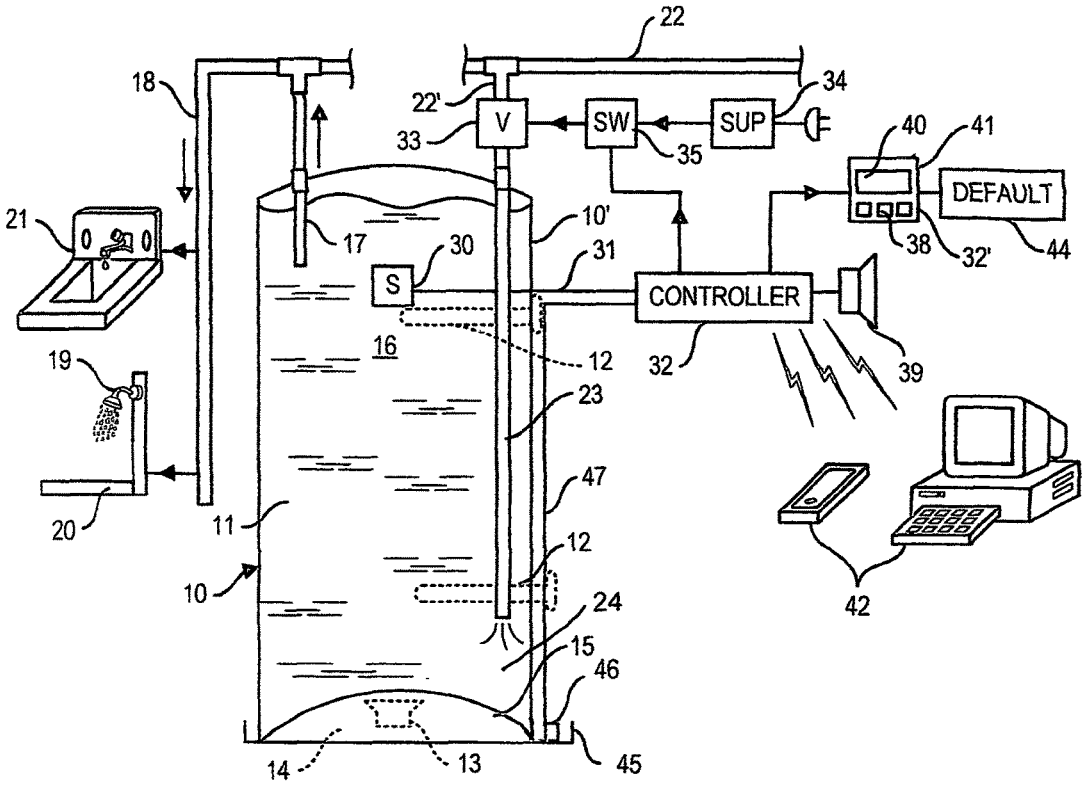
FIG. 1 is a schematic illustration of a water heater to which is incorporated the automatic hot water pulsating alarm system of the present invention.
Figure 2:
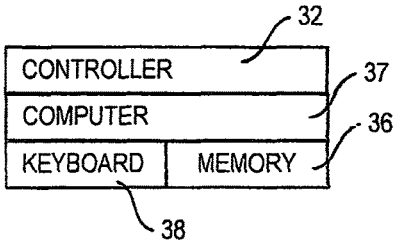
FIG. 2 is a simplified block diagram of the controller computer illustrating, in block form, the basic parts thereof.

Referring now to the drawings, there is shown generally at 10 a water tank of a water heater which contains a volume of water 11 therein. The water 11 is heated by resistive heating elements 12, shown in phantom lines, for an electric water heater or a gas-burner 13, also shown in phantom lines, mounted in a combustion chamber 14 below the bottom wall 15 of the tank, for a gas-fired water heater. Water in the tank is maintained at a temperature of about 140 degrees F. by the heating devices 12 or 13. Hot water from the tank 10 is drawn from the upper region 16 of the tank by a water outlet conduit 17 which feeds a hot water supply conduit 18 of a distribution conduit to which is connected dispensing appliances such as the shower head 19, the bathtub 20 and one or more wash basins 21, as illustrated herein. Of course, other appliances are also connected to the supply conduit but the water as used therein does not usually become in contact with a user person body parts, as does a shower head, bathtub faucet or wash basins.

Water drawn from the outlet conduit 17 is replenished by cold water under pressure from the domestic water supply line 22 and introduced into the lower region 24 of the tank 10 through a dip tube 23. Temperature sensors, not shown, but obvious to a person skilled in the art, are associated with the heating devices to keep them functioning on and off to maintain the water temperature in the tank at the desired pre-set temperatures, and as above mentioned normally 140 degrees F. When hot water is drawn the water temperature drops and the heating devices are turned on. Thus, is described the normal operation of a water heater.

As previously pointed out, it is important to prevent the water temperature in the upper region 16 of the tank to fall below a temperature where bacteria growth could occur when water is drawn, as such could risk containing harmful bacteria which if released in the water drawn form the upper region of the tank could become in contact with a user person. Such water temperature drop could be due to several reasons, such as an overdraw of hot water, a malfunction of the heating device or other factors. Therefore, to prevent the dispensation of hot water at too low a temperature the automatic alarm system of the present invention is provided and consists in the installation of a temperature sensor 30 secured to the tank wall 10' in the upper region 16 of the tank 10 to sense the temperature of the tank wall which is at approximately the same temperature as the water 11 in the upper region 16. The temperature sensor 30 as a connection 31 to a computer programmed controller 32 which receives temperature signals from the sensor 30 and which are representative of the temperature of water in the upper region of the tank being drawn through the outlet conduit 17.

The system of the present invention also comprises an electro-mechanical shut-off valve 33 secured to the conduit 22' which interconnects the supply line 22 to the dip tube 23. This shut-off valve 33 is controlled by the controller 32. The electro-mechanical valve 33 is a solenoid operated valve to which is connected a supply voltage 34 through a switch 35. The switch 35 is controlled by the controller 32 to close and open in a predetermined sequence and during a predetermined time period, as programmed in the readable memory 36 of the computer 37 through a keyboard 38 (interface) of the controller 32. The sequence of operation of the controller is recorded in its memory in the form of statements and instructions for its execution. Accordingly, when the controller 32 receives a signal from the sensor 30 that the temperature of the water in the upper region 16 of the tank 10 has fallen to a minimum programmed temperature, the controller initiates its instructions to actuate and de-actuate the switch 35, the consequence of which removes the pressure of water to the tank and reintroduces it with predetermined time delays. The controller 32 is then programmed to send a message or a signal that the water heater has returned to a normal operating condition.

By closing and opening the valve 33 the supply pressure of water in the tank 10 fluctuates on and off causing the hot water supply in the water supply conduit 18 to be interrupted on and off. If during this sequence a user person is in contact with hot water being dispensed through mixing valves of plumbing fixtures, such as a shower head fixture 19, the water will become cold momentarily and then resume its normal temperature in a pulsating manner. This constitutes an alarm signal to a user person that its hot water supply is about to be turned off for safety purposes.

As shown in FIG. 1 the controller 32 is incorporated in a wall-mounted unit 32' equipped with an audible alarm device 39 which emits an audible signal when the supply of hot water is about to be turned off or is turned off. It is also capable of sending messages to remote devices 42, such a portable computer or a i-phone, wirelessly. The controller 32 is also equipped with a default function 44 permitting the user person to by-pass the controller programmed pulsating alarm function.

Once the valve 33 is completely shut-off, the temperature of the water in the tank 10 will rise and once the temperature sensor 30 detects that the water temperature has reached the predetermined safe water temperature programmed, the controller will receive the temperature signal causing the controller to open the valve 33 and re-establish the water supply to the tank 10 permitting hot water to be drawn from the tank, and this is all done automatically by the controller. In the programmed function of the computer, if it is detected that the water heater is in a malfunction state which could be caused by defective heating devices or other reasons programmed in the memory of the computer, it will issue an audible signal and display an appropriate message on its screen 40 asking that the water heater be serviced.

As also illustrated in FIG. 1, the controller 32 may also have an added function of detecting water leaks from the tank 10 of the water heater. To this end, there is mounted adjacent the bottom end of the water heater or in a water heater pan 45, of the water heater, a water detector 46 which can detect the presence of water. This detector has a wire connection 46 to the controller 32 and which when detected can display that the tank is leaking and enable the audible alarm 39 which can emit a pulsating sound, send a text message, e-mail or any other form of communication means, to alert the user person of such leakage. The controller 32 could also be programmed to shut off the valve 33 in such event to cut off the supply of water to the tank.

The computer implemented method for initiating a hot water pulsating alarm by the controller 32 of the present invention can be summarized as follows. The controller 32 detects a low temperature signal from the sensor 30 indicating that the water temperature in the upper region of the tank has fallen below a predetermined temperature, which may be unsafe or not allow for sufficient hot water to meet the supply requirements of the user. Upon detection of this temperature signal the controller 32 enters its programmed function of operating the switch 35 to open and close the switch at predetermined time intervals and thus pulsating any supply of hot water to the hot water supply conduit 18. Accordingly, a user person currently using hot water in contact with a body part thereof will sense the fluctuating temperature of water. This fluctuating water temperature from hot to cold is a signal that the tank of the water heater is running out of hot water and that the water heater will be shut off until the hot water resumes to normal temperature, unless the user bypasses the safety function of the controller.

It is within the ambit of the present invention to cover any obvious modifications and improvements of the preferred embodiment described herein provided such fall within the ambit of the appended claims.

The invention claimed is:

1. A hot water pulsating alarm system for water heaters comprising a controller, a temperature sensor secured to a water tank of said water heater in an upper region of said water tank where hot water is drawn through a water outlet to feed a hot water supply conduit, said temperature sensor feeding temperature signals to said controller representative of actual water temperature in said upper region of said water tank, a domestic water supply conduit to feed water under pressure to a water inlet conduit of said water tank to replenish water in said water tank drawn through said water outlet, a shut-off valve secured to said water inlet conduit, a communication link between said controller and said shut-off valve for operating the state of said shut-off valve, said controller having a computer readable memory having recorded thereon statements and instructions for executing by a computer said statements and instructions when receiving predetermined temperature signals from said temperature sensor, said controller when receiving a predetermined low temperature signal from said sensor causing said shut-off valve to be operated to close and open in a predetermined sequence and during a predetermined time period to cause interruptions of said water under pressure to said water inlet and consequently to said feed of hot water to said hot water supply conduit in the event that hot water is being drawn to create a pulsating water temperature change of water being drawn through fixtures connected to said hot water supply conduit and which temperature change constitutes a pulsating signal to a user person having a body part in contact with said pulsating water temperature change that said water heater will be shut off.

2. The hot water pulsating alarm system as claimed in claim 1 wherein said controller is programmed to re-open said valve upon receiving a predetermined high water temperature signal from said temperature sensor and generating a signal to said user person that said water heater as returned to a normal operating condition.

3. The hot water pulsating alarm system as claimed in claim 2 wherein said low temperature signal is indicative of a water temperature wherein bacteria could proliferate, said high temperature signals being indicative of a water temperature typically of 140 degrees F. or other high temperature setpoint of an upper thermostat.

4. The hot water pulsating alarm system as claimed in claim 1 wherein said shut-off valve is a solenoid operated valve connected to a voltage supply, a switch connecting said voltage supply to said shut-off valve, said switch being operated to close and open said valve at said predetermined programmed sequence.

5. The hot water pulsating alarm system as claimed in claim 1 wherein said fixtures include counter basins, shower heads, and bathtub fixtures equipped with water mixing valves to mix hot and cold water to control the water temperature being dispensed through said fixtures.

6. The hot water pulsating alarm system as claimed in claim 1 wherein there is further provided a local audible alarm device controlled by said controller, said controller having a programmed function to operate said local audible alarm device upon reception of said predetermined low temperature signal.

7. The hot water pulsating alarm system as claimed in claim 1 wherein said controller is programmed to communicate a water heater shut-down signal to a wireless communication device upon reception of said predetermined low temperature signal, and a further signal upon restored normal operating conditions of said water heater.

8. The hot water pulsating alarm system as claimed in claim 7 wherein there is further provided a default function programmed in said computer memory which when inputted by a user person causes said operation of said shut-off valve by said controller to be disabled.

9. The hot water pulsating alarm system as claimed in claim 1 wherein there is further provided a water leak sensor secured adjacent a bottom end of said water heater, said water leak sensor having a connection connected to said controller to provide a signal indicative of water being present adjacent said bottom end of said water heater, said controller operating said shut-off valve to close said feed of water under pressure to said water tank upon detection of a water leak.

10. A computer implemented method for automatically initiating a hot water pulsating alarm by a controller of a water heater which controls a shut-off valve connected to a domestic water supply conduit which feed water under pressure to a water inlet conduit of a water tank of said water heater, said water tank having a water outlet in said upper regions thereof to draw hot water to feed a hot water supply conduit, said method comprising the steps of:

(i) providing a controller having a computer readable memory having recorded thereon statements and instructions for executing by a computer said statements and instructions, (ii) sensing by a temperature sensor the water temperature in an upper region of said water tank, (iii) feeding temperature signals to said controller indicative of actual water temperatures sensed by said temperature sensor, (iv) operating a shut-off valve by said controller, when receiving a predetermined low temperature signal from said temperature sensor, to close and open said shut-off valve in a predetermined sequence for a predetermined period of time to cause interruptions of said water under pressure to said water inlet and consequently to said feed of hot water to said hot water supply conduit to create a pulsating water temperature change of water being drawn through fixtures connected to said hot water supply conduit and which temperature change constitutes a pulsating signal to a user person having a body part exposed to said pulsating water temperature change that said water heater will be shut-off.

11. The method of claim 10 wherein after step (iv) there is provided the step of said controller operating said shut-off valve to close until said controller receives a predetermined high actual water temperature signal from said temperature sensor, said controller causing said shut-off valve to open upon receiving said high temperature signal.

12. The method of claim 11 wherein after said step (iv) there is further provided the step of said controller communicating the closure and opening of said shut-off valve to remote wireless communication devices upon reception of said predetermined low and high temperature signals and the closure thereof, and a further signal upon the restoration to normal condition of said water heater.

13. The method of claim 10 wherein said step (iv) comprises operating a switch through which is fed a voltage supply for operating said shut-off valve, said shut-off valve being a solenoid valve.

14. The method of claim 10 wherein after step (iv) there is further provided the step of operating a local audible alarm device by said controller when receiving said predetermined low temperature signal.

15. The method of claim 10 wherein there is further provided the step of detecting water leakage in a bottom end of said water heater indicative of leakage of water from said water tank, feeding a water leak detecting signal to said controller by a water leak detector, said controller having a programmed function to operate said shut-off valve to close said feed of water under pressure to said water tank upon receiving a water leak signal from said water leak detector.

16. A computer programmed controller comprising a computer readable memory having computer executable instructions thereon that when executed by a computer preform the method steps of claim 10.

* * * * *